US008643686B2

(12) United States Patent
Derimiggio et al.

(10) Patent No.: US 8,643,686 B2
(45) Date of Patent: Feb. 4, 2014

(54) VARIABLE RATE FUSER RELEASE FLUID APPLICATION

(75) Inventors: John E Derimiggio, Fairport, NY (US); Paul M Fromm, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 1477 days.

(21) Appl. No.: 12/243,380

(22) Filed: Oct. 1, 2008

(65) Prior Publication Data

US 2010/0079560 A1 Apr. 1, 2010

(51) Int. Cl.

| | |
|---|---|
| ***B41J 2/385*** | (2006.01) |
| ***B41J 2/195*** | (2006.01) |
| ***B41J 29/38*** | (2006.01) |
| ***B41J 29/393*** | (2006.01) |
| ***B41J 2/01*** | (2006.01) |

(52) U.S. Cl.
USPC ..... 347/156; 347/7; 347/14; 347/19; 347/103; 399/397; 399/400

(58) Field of Classification Search
USPC ..... 347/7, 14, 19, 101–104, 156; 399/68, 399/325, 394, 397, 400
See application file for complete search history.

(56) References Cited

U.S. PATENT DOCUMENTS

| | | | | |
|---|---|---|---|---|
| 5,200,786 | A * | 4/1993 | Fromm et al. | 399/325 |
| 5,729,818 | A * | 3/1998 | Ishizuka et al. | 399/400 |
| 5,974,293 | A * | 10/1999 | Fromm | 399/325 |
| 7,177,585 | B2 | 2/2007 | Matsuzaka et al. | |
| 2002/0044805 | A1 * | 4/2002 | Hasegawa | 399/325 |
| 2004/0101333 | A1 * | 5/2004 | Wu et al. | 399/325 |
| 2008/0037069 | A1 | 2/2008 | Mestha et al. | |

* cited by examiner

*Primary Examiner* — Charlie Peng
*Assistant Examiner* — Hung Lam
(74) *Attorney, Agent, or Firm* — Ronald E. Prass, Jr.; Prass LLP

(57) ABSTRACT

According to various illustrative embodiments, an apparatus, method, and system for variable rate fuser release fluid application are described. In one aspect, the apparatus comprises a supply of release agent material. The apparatus also comprises a release agent metering roller supported for contact with the supply of the release agent material. The apparatus also comprises a variable speed drive arranged to effect movement of the release agent metering roller in an endless path at different surface velocities. The apparatus also comprises a donor roller supported in contact with the release agent metering roller and a fuser roller of a contact fuser, the donor roller arranged to convey release agent material from the release agent metering roller to the fuser roller at various rates depending on a surface velocity of the release agent metering roller, wherein the variable speed drive is operative independently of the fuser roller.

22 Claims, 5 Drawing Sheets

VARIABLE RATE FUSER RELEASE FLUID APPLICATION

RELATED APPLICATIONS

This application is related to the application Ser. No. 12/243,576 ventitled "Variable Rate Fuser Release Fluid Application In An Ink Jet Printer," which is filed on the same date as the present application, which is commonly assigned to the assignee of the present application, and which is incorporated herein by reference in its entirety.

BACKGROUND

The present disclosure relates generally to fuser release fluid application in imaging systems. More particularly, the present disclosure describes an apparatus, method, and system useful for providing variable rate fuser release fluid application in imaging systems.

The fuser release fluid application rate may be an important parameter for fuser operation. Normally, fuser fluid applicators are designed for a nominal rate that is not easily adjusted or tuned. As a result, fuser fluid applicators are vulnerable to release fluid rate variability due to part variations and wear as well as effects of different media. Moreover, given media and/or job type, there is an optimum release fluid rate, but for fixed rate release fluid application systems, the rate has to be chosen so that the most demanding job within the operating specifications receives sufficient release fluid. Consequently, many other job types will get more release fluid, such as silicone oil, than is needed, which often contributes to secondary negative effects, such as prints getting oily and/or objects failing to stick to the paper and/or excess oil getting spread to other components when duplexing, for example.

SUMMARY

According to various illustrative embodiments, an apparatus, method, and system for variable rate fuser release fluid application are described. In one aspect, the apparatus comprises a supply of release agent material. The apparatus also comprises a release agent metering roller supported for contact with the supply of the release agent material. The apparatus also comprises a variable speed drive arranged to effect movement of the release agent metering roller in an endless path at different surface velocities. The apparatus also comprises a donor roller supported in contact with the release agent metering roller and a fuser roller of a contact fuser, the donor roller arranged to convey release agent material from the release agent metering roller to the fuser roller at various rates depending on a surface velocity of the release agent metering roller, and at least one of the following: an amount of release agent material left on the donor roller, a film thickness of release agent material on the release agent metering roller, and a speed ratio between the release agent metering roller and the donor roller, wherein the variable speed drive is operative independently of the fuser roller.

BRIEF DESCRIPTION OF THE DRAWINGS

The following figures form part of the present specification and are included to further demonstrate certain aspects of the disclosed features and functions, and should not be used to limit or define the disclosed features and functions. Consequently, a more complete understanding of the present embodiments and further features and advantages thereof may be acquired by referring to the following description taken in conjunction with the accompanying drawings, wherein.

It is to be noted, however, that the appended drawings illustrate only typical embodiments of the disclosed subject matter and are, therefore, not to be considered limiting of the scope of the disclosed subject matter, as the disclosed subject matter may admit to other equally effective embodiments.

DETAILED DESCRIPTION

Illustrative embodiments are described in detail below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of the present disclosure.

Figure 1:
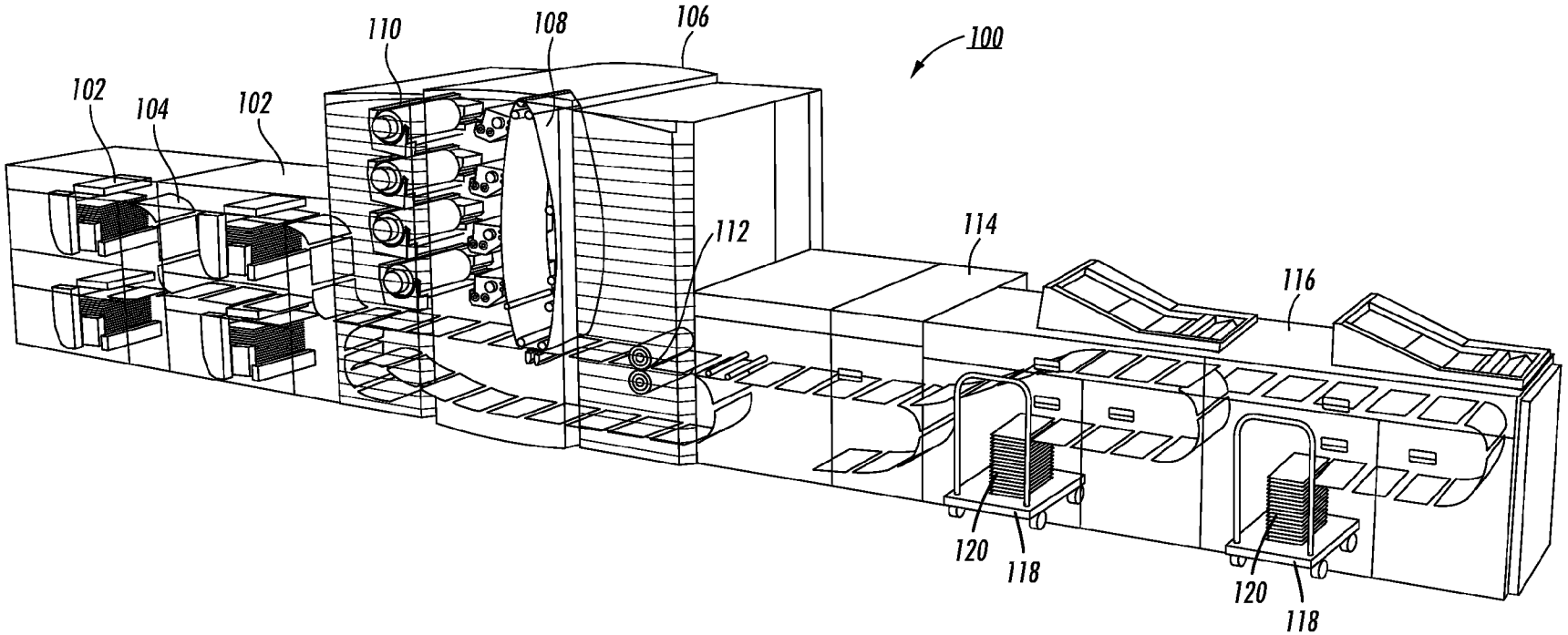
FIG. 1 schematically illustrates a particular example of various illustrative embodiments of an apparatus in accord with the present disclosure.

FIG. 1 illustrates an exemplary printing apparatus 100, such as disclosed in U.S. Patent Application Publication No. 2008/0037069, which is incorporated herein by reference in its entirety. As used herein, the term "printing apparatus" encompasses any apparatus, such as a digital copier, bookmaking machine, multifunction machine, and the like, that performs a print outputting function for any purpose. The printing apparatus 100 can be used to produce prints from various types of media, such as coated or uncoated (plain) paper sheets, at high speeds. The media can have various sizes and weights. In embodiments, the printing apparatus 100 has a modular construction. As shown, the apparatus includes two media feeder modules 102 arranged in series, a printer module 106 adjacent the media feeding modules 102, an inverter module 114 adjacent the printer module 106, and two stacker modules 116 arranged in series adjacent the inverter module 114.

In the printing apparatus 100, the media feeder modules 102 are adapted to feed media having various sizes (widths and lengths) and weights to the printer module 106. In the printer module 106, toner is transferred from a series of developer stations 110 to a charged photoreceptor belt 108 to form toner images on the photoreceptor belt and produce color prints. The toner images are transferred to one side of respective media 104 fed through the paper path. The media are advanced through a fuser 112 adapted to fuse the toner images on the media. The inverter module 114 manipulates media exiting the printer module 106 by either passing the media through to the stacker modules 116, or inverting and returning the media to the printer module 106. In the stacker modules 116, the printed media are loaded onto stacker carts 118 to form stacks 120.

Figure 2:
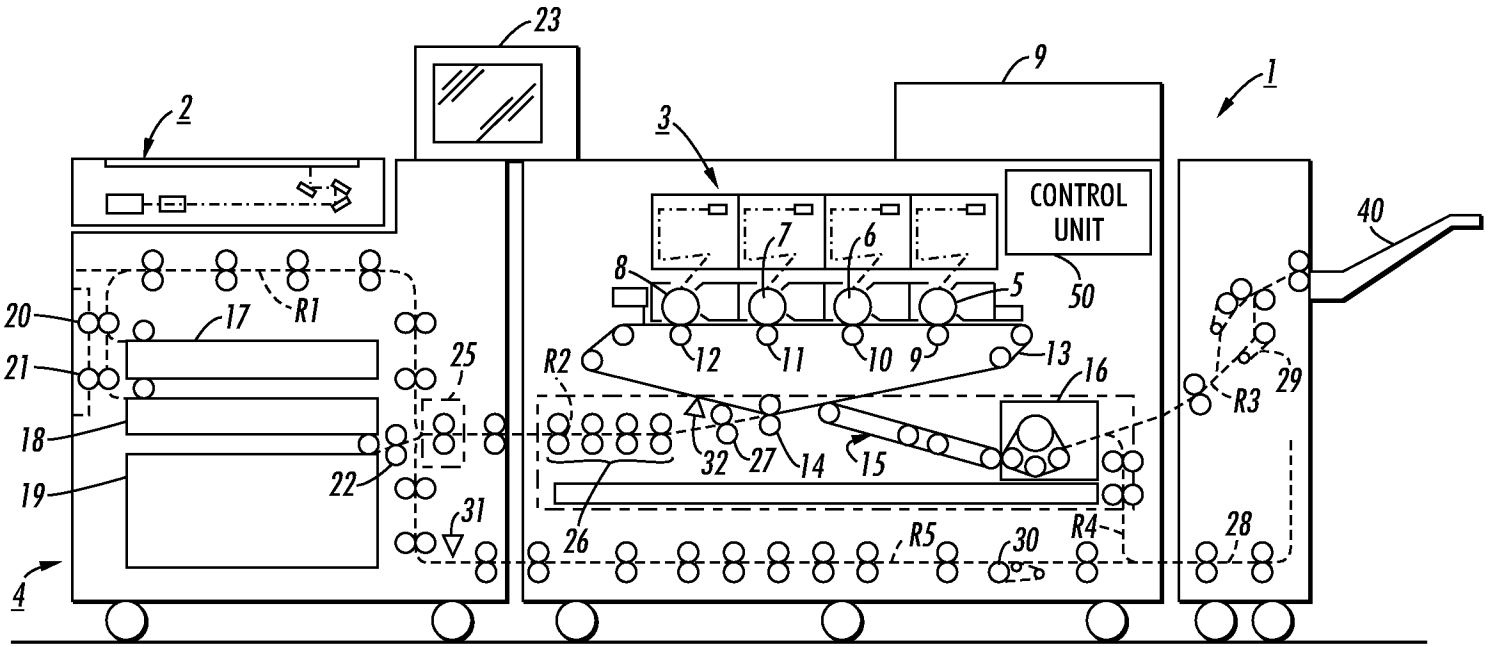
FIG. 2 schematically illustrates a particular example of various illustrative embodiments of an apparatus in accord with the present disclosure.

FIG. 2 illustrates an overall configuration of an image forming apparatus 1. The apparatus 1 may be known as "an intermediate belt printing apparatus." The image forming apparatus capable of outputting full-color images primarily includes: an image read unit 2 that reads an image of an original; an image forming unit 3 that forms an image on a sheet; and a sheet feeding unit 4 that feeds the sheet to the image forming unit 3. The image forming apparatus 1 has a control unit 50 that controls the whole of the image forming apparatus 1.

The image read unit 2 reads an image of an original set on a transparent original base. It includes: an optical scanning system having, e.g., a lamp, mirror, carriage, and the like; a lens system for forming an optical image scanned by the optical scanning system; and an image read sensor such as CCD that receives the optical image formed by the lens system and converts it into an electric signal.

The image forming unit 3 has a so-called four-train tandem configuration that includes: four photoconductive drums 5, 6, 7, and 8 juxtaposed in a horizontal direction correspondingly to yellow (Y), magenta (M), cyan (C), and black (K); four primary transfer rolls 9, 10, 11, and 12 disposed correspondingly to the photoconductive drums 5 to 8; an intermediate transfer belt 13 as an intermediate transfer member (transfer member) to which toner images formed on the photoconductive drums 5 to 8 are successively subjected to primary transfer; a secondary transfer roll 14 that subjects toner images superimposed on the intermediate transfer belt 13 to secondary transfer to sheets in the secondary transfer unit; a vacuum transportation unit 15 that transports sheets having been subjected to the secondary transfer; and a fixing unit (fuser) 16 that fixes the toner images on the sheets having been subjected to the secondary transfer.

There are respectively disposed in the periphery of the photoconductive drums 5 to 8: electrifiers that evenly electrify the surface of the photoconductive drums 5 to 8; laser writing apparatuses that form static latent images by irradiating laser to the surface of the photoconductive drums 5 to 8 electrified by the electrifiers; developer units that develop static latent images formed on the photoconductive drums 5 to 8 by predetermined color component toners to form visible images; cleaners that eliminate residual toners remaining on the surface of the photoconductive drums 5 to 8 after the primary transfer; and the like. The primary transfer rolls 9 to 12 are disposed in the vicinity of and in opposed relation to the corresponding photoconductive drums 5 to 8 through the intermediate transfer belt 13. The primary transfer rolls 9 to 12 subject toner images formed on the corresponding photoconductive drums 5 to 8 to primary transfer to the intermediate transfer belt 13. The intermediate transfer belt 13 is stretched in a loop form by plural (five in this example) support rolls.

The secondary transfer roll 14 is disposed opposite to the intermediate transfer belt 13. The secondary transfer roll 14 subjects superimposed toner images of different colors successively subjected to primary transfer onto the intermediate transfer belt 13 to secondary transfer (collective transfer) to sheets. The vacuum transportation unit 15 attracts and transports to the fixing unit (fuser) 16 the sheets to which the toner images have been transferred by the secondary transfer roll 14. The fixing unit (fuser) 16 fixes the toner images to the sheets by heating and pressing.

The sheet feeding unit 4 transports sheets of different colors, weight, sizes, and the like, housed in a first tray 17, a second tray 18, and a third tray 19 through corresponding transportation paths. In the vicinity of the trays 17 to 19 are disposed feeding rolls 20, 21, and 22 corresponding to them. The feeding rolls 20 to 22 nip sheets taken out one at a time in a separated form from corresponding trays 17 to 19 and temporarily halt them on sheet transportation paths, and at a timing based on a predetermined start signal, feed them to the downstream side of sheet transportation direction. In the vicinity of the image read unit 2 is provided an operation panel 23 operated by users.

Transportation rolls for transporting sheets are disposed in proper positions of sheet transportation paths R1 to R5 extending to a discharge tray 40 via image formation processing positions of the image forming unit 3 from sheet feeding positions of the feeding rolls 20 to 22. A sheet housed in the first tray 17 is fed by the feeding roll 20, then fed to a junction transportation unit 25 via the first sheet transportation path R1. On the other hand, a sheet housed in the third tray 19 is directly fed to the junction transportation unit 25 by the feeding roll 22.

The sheet fed to the junction transportation unit 25 is fed to image formation processing positions of the image forming unit 3 via a second sheet transportation path R2. Further, the sheets passing through the image formation processing positions is fed to the fixing unit 16 by the vacuum transportation unit 15, then discharged to the discharge tray 40 via the third sheet transportation path R3. On the other hand, a sheet on the both sides of which images are formed passes through the fixing unit 16, then fed to a double side reversion unit 28 via a fourth sheet transportation path R4, where the sides of the sheet are reversed, and fed back to the junction transportation unit 25 via a fifth sheet transportation path R5. When the sides of the sheet have been reversed by these reversion transportation paths, the rear edge of the sheet transported to form a first side becomes the front edge of the sheet when the second side is formed.

In the sheet transportation paths R1 to R5, there are disposed a posture correction unit 26 that corrects the posture of sheet transported through the second sheet transportation path R2, and a registration roll 27 that has a pair of rolls held in close contact with each other, and feeds a sheet to the image formation processing positions by rotating the pair of rolls while nipping the sheet between the roll pair. The registration roll 27 is adjusted in terms of sheet arrival timing for image formation processing when feeding the sheet, by a timing adjustment module not shown. The sheet transportation paths R3 and R5 are respectively provided with curl correction units 29 and 30 for correcting sheet curl produced during fixing in the fixing unit 16.

There are provided a first side read sensor 31 as a first sensor and an image detection sensor 32 as a second sensor. The first side read sensor 31 detect the arrival of the front edge of a sheet reversed in side through the fourth and fifth paper transportation paths R4 and R5, and detects register marks formed on the first side and the positions of reference images. The image detection sensor 32 detects register marks superimposed on the intermediate transfer belt 13 and toner images of reference images. The register mark is a reference mark used in the printing industry and the like to register multiple color plates. The register marks include a center register mark, a fold register mark, and a cut register mark. These register marks are formed as lines having a predetermined length in a direction (fast-scan direction) orthogonal to a sheet transportation direction and in a sheet transportation direction (slow-scan direction). The image forming apparatus 1 can form images on a sheet as reference positions of cutting lines when the sheet after image formation is cut. According to cut positions, users can freely specify, e.g., 5 mm, 10 mm, and 15 mm from the front edge of a sheet. The setting can be performed by a computer apparatus (not shown) connected to the image forming apparatus 1.

The distance between the image detection sensor 32 and the secondary transfer unit (the position where the intermediate transfer belt 13 and the secondary transfer roll 14 abut against each other) on the intermediate transfer belt 13 is longer than the distance between the registration roll 27 and the secondary transfer unit, e.g., by 5 mm or more. This setting enables control of registration feeding timing of a second side (registration timing in a lead direction (sheet transportation direction)) as described later. The image forming unit 3 in this embodiment functions as one of reference image printing units that print given reference images.

Figure 3:
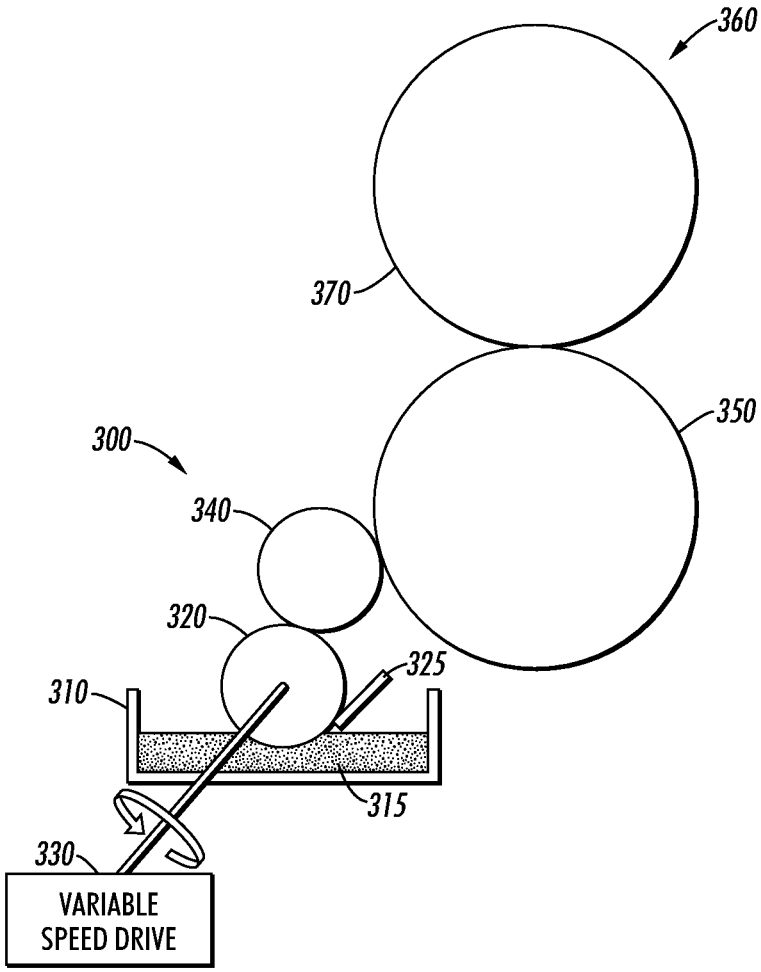
FIG. 3 schematically illustrates a particular example of various illustrative embodiments of an apparatus in accord with the present disclosure.

In various illustrative embodiments, as shown in FIG. 3, for example, an apparatus 300 for variable rate fuser release fluid application may include a supply 310 of release agent material 315. The apparatus 300 may be used in conjunction with embodiments shown in FIGS. 1 and 2. For example, the apparatus 300 may be used in conjunction with the fuser 112 of FIG. 1 or in conjunction with the fuser 16 of FIG. 2.

In various illustrative embodiments, the release agent material 315 may include a functional silicone oil, for example. The apparatus 300 may also include a release agent metering roller 320 supported for contact with the supply 310 of the release agent material 315. The apparatus 300 may also include a variable speed drive 330 arranged to effect movement of the release agent metering roller 320 in an endless path at different surface velocities. In various illustrative embodiments, the variable speed drive 330 may be a motor or variable ratio transmission. The apparatus 300 may also include a donor roller 340 supported in contact with the release agent metering roller 320 and a fuser roller 350 of a contact fuser 360, the donor roller 340 arranged to convey release agent material 315 from the release agent metering roller 320 to the fuser roller 350 at various rates depending on a surface velocity of the release agent metering roller 320, and at least one of the following items: an amount of release agent material 315 left on the donor roller 340, a film thickness of release agent material 315 on the release agent metering roller 320, and a speed ratio between the release agent metering roller 320 and the donor roller 340, wherein the variable speed drive 330 is operative independently of the fuser roller 350.

In various illustrative embodiments, the donor roller 340 may be elastomer covered. In various illustrative embodiments, the donor roller 340 may be driven by the fuser roller 350. In various illustrative embodiments, the donor roller 340 may slip relative to the release agent metering roller 320. In various illustrative embodiments, the release agent metering roller 320 may include a metal having a ground, extruded, molded, or turned surface. In various other illustrative embodiments, the release agent metering roller 320 may include plastic, aluminum, ceramic or other material having a ground, extruded, molded, or turned surface.

In various illustrative embodiments, the release agent material 315 may be picked up from the supply 310 by the release agent metering roller 320 and then the film thickness of the release agent material 315 may be lowered by a contacting doctor or metering blade 325, as shown in FIG. 1, for example. The release agent material 315 may then be transferred nip to nip until a thin film of the release agent material 315 may be applied to the fuser roller 350. The amount of the release agent material 315 that may be applied to the fuser roller 350 may depend on the film thickness of the release agent material 315 between the release agent metering roller 320 and the donor roller 340. If the release agent metering roller 320 rotational speed is controlled independently of the rotational speed of the donor roller 340, then the film thickness of the release agent material 315 between the release agent metering roller 320 and the donor roller 340 may be varied. Varying the film thickness of the release agent material 315 between the release agent metering roller 320 and the donor roller 340 will vary the amount of the release agent material 315 that may be applied to the fuser roller 350.

In various illustrative embodiments, if the rotational speed of the release agent metering roller 320 is very low, at least two effects will combine to lower the amount of the release agent material 315 that is delivered to the fuser roller 350. One effect is that the film thickness of the release agent material 315 left on the release agent metering roller 320 after the doctor blade 325 will decrease as the rotational speed decreases due to lubrication theory. Another effect is that the rate of transporting the film thickness of the release agent material 315 on the release agent metering roller 320 to the donor roller 340 is reduced. As the release agent metering roller 320 rotational speed is increased, the film thickness of the release agent material 315 on the release agent metering roller 320 will increase and the rate of presenting this film of the release agent material 315 to the donor roller 340 increases. As a result, the rate of the application of the release agent material 315 to the fuser roller 350 may be substantially continuously adjustable and variable.

In various illustrative embodiments, the release agent metering roller 320 may be driven by the variable speed drive 330 at an independently controlled rotational speed. By doing so, the relative motion between the donor roller 340, which may be driven by friction with the fuser roller 350, and the release agent metering roller 320 may be varied. As the rotational speeds vary, the sheer plane within the release agent material 315 layer between the release agent metering roller 320 and the donor roller 340 changes as well as the overall amount of the release agent material 315 being pulled from the supply 310 by the release agent metering roller 320. This results in an adjustable amount of release agent material 315 being applied to the fuser roller 350.

Figure 4:
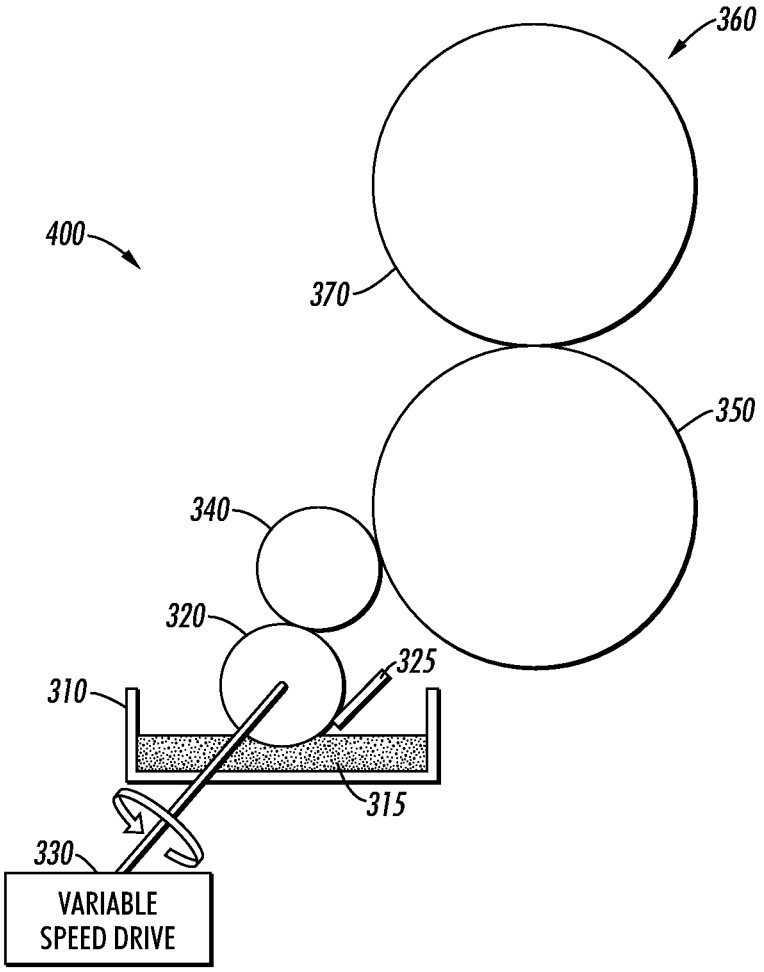
FIG. 4 schematically illustrates a particular example of various illustrative embodiments of a system in accord with the present disclosure.

In various illustrative embodiments, as shown in FIG. 4, for example, a system 400 for variable rate fuser release fluid application may include the supply 310 of the release agent material 315. In various illustrative embodiments, the release agent material 315 may include a functional silicone oil, for example. The system 400 may also include the release agent metering roller 320 supported for contact with the supply 310 of the release agent material 315. The system 400 may also include the variable speed drive 330 arranged to effect movement of the release agent metering roller 320 in an endless path at different surface velocities. In various illustrative embodiments, the variable speed drive 330 may be a motor or variable ratio transmission. The system 400 may also include the donor roller 340 supported in contact with the release agent metering roller 320 and the fuser roller 350 of the contact fuser 360, the donor roller 340 arranged to convey release agent material 315 from the release agent metering roller 320 to the fuser roller 350 at various rates depending on the surface velocity of the release agent metering roller 320, and at least one of the following items: an amount of release agent material 315 left on the donor roller 340, the film thickness of release agent material 315 on the release agent metering roller 320, and the speed ratio between the release agent metering roller 320 and the donor roller 340, wherein the variable speed drive 330 is operative independently of the fuser roller 350. The system 400 may also include a pressure roller 370 of the contact fuser 360, the pressure roller 370 supported in contact with the fuser roller 350 of the contact fuser 360.

Figure 5:
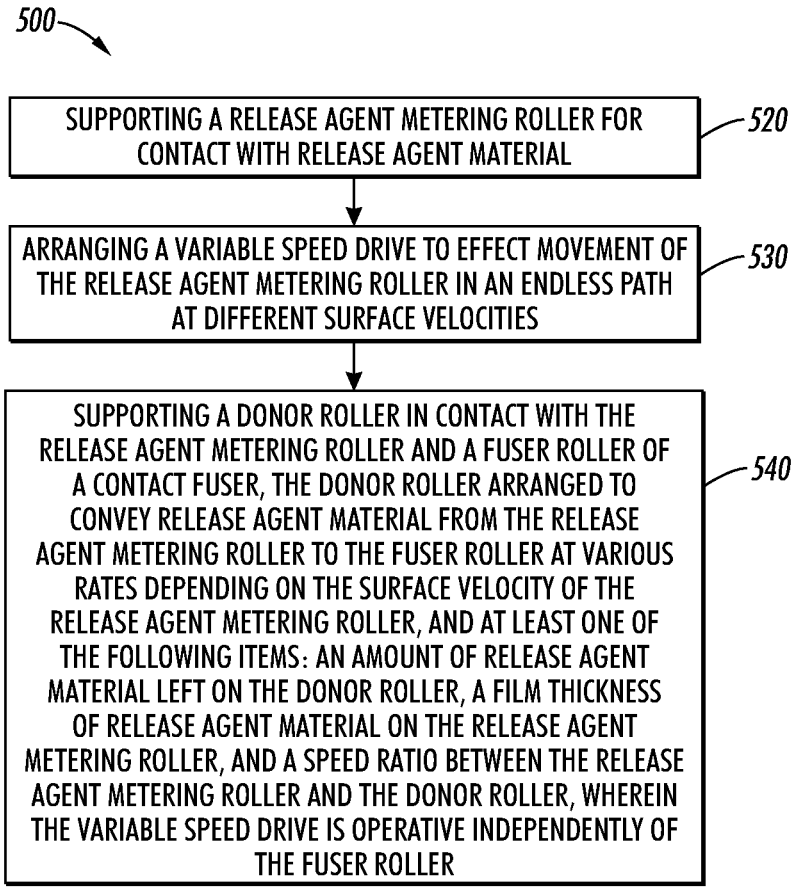
FIG. 5 schematically illustrates a particular example of various illustrative embodiments of a method in accord with the present disclosure.

FIG. 5 schematically illustrates a particular example of various illustrative embodiments of a method 500 useful for variable rate fuser release fluid application, in accord with the present disclosure. The method 500 includes supporting the release agent metering roller 320 for contact with release agent material 315, as shown at 520. The method 500 includes arranging the variable speed drive 330 to effect movement of the release agent metering roller 320 in an endless path at different surface velocities, as shown at 530. The method 500 also includes supporting the donor roller 340 in contact with the release agent metering roller 320 and the fuser roller 350 of the contact fuser 360, the donor roller 340 arranged to convey release agent material 315 from the release agent metering roller 320 to the fuser roller 350 at various rates depending on the surface velocity of the release agent metering roller 320, and at least one of the following items: an amount of release agent material 315 left on the donor roller 340, the film thickness of release agent material 315 on the release agent metering roller 320, and the speed ratio between the release agent metering roller 320 and the donor roller 340, wherein the variable speed drive 330 is operative independently of the fuser roller 350, as shown at 540.

In accordance with the present disclosure, an apparatus, system, and method useful for variable rate fuser release fluid application are disclosed. In various aspects, an apparatus in accordance with the present disclosure may include means for variable rate fuser release fluid application and means for enabling the means for variable rate fuser release fluid application, both the means for variable rate fuser release fluid application and the means for enabling the means for variable rate fuser release fluid application covering corresponding structures and/or materials described herein and equivalents thereof.

In various other aspects, a system in accordance with the present disclosure may include means for variable rate fuser release fluid application, means for enabling the means for variable rate fuser release fluid application, and means for using the means for variable rate fuser release fluid application, all of the means for variable rate fuser release fluid application, the means for enabling the means for variable rate fuser release fluid application, and the means for using the means for variable rate fuser release fluid application covering corresponding structures and/or materials described herein and equivalents thereof. In yet various other aspects, a method in accordance with the present disclosure may include steps for variable rate fuser release fluid application and steps for enabling the steps for variable rate fuser release fluid application, both the steps for variable rate fuser release fluid application and the steps for enabling the steps for variable rate fuser release fluid application covering corresponding acts described herein and equivalents thereof.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. An apparatus for variable rate fuser release fluid application, the apparatus comprising:

a release agent metering roller supported for contact with a supply of release agent material;

a variable speed drive arranged to effect movement of the release agent metering roller in an endless path at different surface velocities; and a donor roller supported in contact with the release agent metering roller and a fuser roller of a contact fuser, the donor roller defining a first nip with the metering roller, the donor roller defining a second nip with the fuser roller, the donor roller arranged to convey release agent material from the release agent metering roller to the fuser roller at various rates depending on a surface velocity of the release agent metering roller, an amount of release agent material left on the donor roller, a film thickness of release agent material on the release agent metering roller, and a speed ratio between the release agent metering roller and the donor roller, wherein the variable speed drive is operative independently of the fuser roller.

2. The apparatus of claim 1, wherein the donor roller is elastomer covered.

3. The apparatus of claim 1, wherein the donor roller is driven by the fuser roller.

4. The apparatus of claim 2, wherein the donor roller is driven by the fuser roller.

5. The apparatus of claim 1, wherein the donor roller slips relative to the release agent metering roller.

6. The apparatus of claim 2, wherein the donor roller slips relative to the release agent metering roller.

7. The apparatus of claim 3, wherein the donor roller slips relative to the release agent metering roller.

8. The apparatus of claim 4, wherein the donor roller slips relative to the release agent metering roller.

9. The apparatus of claim 1, wherein the release agent metering roller comprises a material including metal, plastic, aluminum, or ceramic, wherein the material has a surface that is ground, extruded, molded, or turned.

10. The apparatus of claim 8, wherein the release agent metering roller comprises a material including metal, plastic, aluminum, or ceramic, wherein the material has a surface that is ground, extruded, molded, or turned.

11. An intermediate belt printing apparatus comprising the apparatus of claim 1.

12. A method for variable rate fuser release fluid application, the method comprising:

supporting a release agent metering roller for contact with release agent material;

arranging a variable speed drive to effect movement of the release agent metering roller in an endless path at different surface velocities; and supporting a donor roller in contact with the release agent metering roller and a fuser roller of a contact fuser, the donor roller defining a first nip with the metering roller, the donor roller defining a second nip with the fuser roller, the donor roller arranged to convey release agent material from the release agent metering roller to the fuser roller at various rates depending on a surface velocity of the release agent metering roller, an amount of release agent material left on the donor roller, a film thickness of release agent material on the release agent metering roller, and a speed ratio between the release agent metering roller and the donor roller, wherein the variable speed drive is operative independently of the fuser roller.

13. The method of claim 2, wherein the donor roller is elastomer covered.

14. The method of claim 12, wherein the donor roller is driven by the fuser roller.

15. The method of claim 13, wherein the donor roller is driven by the fuser roller.

16. The method of claim 12, wherein the donor roller slips relative to the release agent metering roller.

17. The method of claim 13, wherein the donor roller slips relative to the release agent metering roller.

18. The method of claim 14, wherein the donor roller slips relative to the release agent metering roller.

19. The method of claim 15, wherein the donor roller slips relative to the release agent metering roller.

20. The method of claim 12, wherein the release agent metering roller comprises a material including metal, plastic, aluminum, or ceramic, wherein the material has a surface that is ground, extruded, molded, or turned.

21. A system for variable rate fuser release fluid application, the system comprising:

a release agent metering roller supported for contact with a supply of release agent material;

a variable speed drive arranged to effect movement of the release agent metering roller in an endless path at different surface velocities;

a donor roller supported in contact with the release agent metering roller and a fuser roller of a contact fuser, the donor roller defining a first nip with the metering roller, the donor roller defining a second nip with the fuser roller, the donor roller arranged to convey release agent material from the release agent metering roller to the fuser roller at various rates depending on a surface velocity of the release agent metering roller, an amount of release agent material left on the donor roller, a film thickness of release agent material on the release agent metering roller, and a speed ratio between the release agent metering roller and the donor roller, wherein the variable speed drive is operative independently of the fuser roller; and a pressure roller of the contact fuser, the pressure roller supported in contact with the fuser roller of the contact fuser.

22. An intermediate belt printing apparatus comprising the system of claim 21.

* * * * *